US008105058B2

(12) United States Patent
Schlecht

(10) Patent No.: US 8,105,058 B2
(45) Date of Patent: Jan. 31, 2012

(54) DRYWALL MUD PUMP WITH IMPROVED CONNECTION BETWEEN THE PISTON AND THE ROD

(75) Inventor: Werner L. Schlecht, Paradise Valley, AZ (US)

(73) Assignee: Cinta Tools LLC, Scottsdale, AZ (US)

( * ) Notice: Subject to any disclaimer, the term of this patent is extended or adjusted under 35 U.S.C. 154(b) by 1047 days.

(21) Appl. No.: 11/941,619

(22) Filed: Nov. 16, 2007

(65) Prior Publication Data

US 2009/0129957 A1 May 21, 2009

(51) Int. Cl.
*F04B 53/12* (2006.01)
*F16J 1/14* (2006.01)

(52) U.S. Cl. ..... 417/550; 417/555.1; 92/165 PR; 92/179; 92/258

(58) Field of Classification Search ..... 417/555.1, 417/550; 222/330, 401; 92/258, 179, 165 PR, 92/169.1

See application file for complete search history.

(56) References Cited

U.S. PATENT DOCUMENTS 1,076,488 A 10/1913 Deming
1,338,765 A * 5/1920 Brandt ..... 92/240
1,479,075 A * 1/1924 Johnson ..... 417/490
1,624,613 A * 4/1927 McFall ..... 92/221
1,686,308 A 10/1928 Zabriskie
2,403,122 A 7/1946 Reisert et al.
2,423,162 A 7/1947 Summers
2,616,524 A 11/1952 Fox et al.
2,889,857 A 6/1959 Ames
3,009,414 A 11/1961 Griemert
3,231,148 A 1/1966 Miller
3,612,722 A 10/1971 Neward
3,785,535 A 1/1974 Ames
3,960,294 A 6/1976 Bernard
3,985,471 A 10/1976 Seals
4,253,804 A 3/1981 Vanderjagt
4,440,410 A 4/1984 Bradshaw
4,498,192 A 2/1985 Becker et al.
4,573,956 A 3/1986 Johnson
4,726,284 A * 2/1988 Green ..... 92/128
4,767,297 A 8/1988 Mower et al.
4,872,303 A 10/1989 Johnson
4,898,304 A 2/1990 Bacon, Jr.
4,944,215 A * 7/1990 Nimmo et al. ..... 92/168

(Continued)

OTHER PUBLICATIONS

U.S. Appl. No. 11/292,238, filed Nov. 30, 2005, inventor Werner Schlecht, entitled "Drywall Mud Pump" (now abandoned).

(Continued)

*Primary Examiner* — Charles Freay
(74) *Attorney, Agent, or Firm* — Snell & Wilmer L.L.P.

(57) ABSTRACT

Drywall mud pump for pumping drywall joint compound, for instance, from a bucket into a drywall tool. The pump includes a cylinder, a piston, a rod, and a means, or a connection structure between the piston and the rod, for allowing the end of the rod to move laterally relative to the piston. Some embodiments have an elongated hole in the piston that receives a flattened or reduced diameter end of the rod, for example. Different embodiments include a pump head through which the rod passes, a handle, a linkage, a means for allowing the rod to pivot, a shortened guide, a means for preventing the piston from rotating about the rod, or a combination thereof. Pistons may include, for example, passageways with straight and curved sides, a flapper, an elongated washer to block the elongated hole, and a means for controlling the rotational position of the washer.

13 Claims, 3 Drawing Sheets

U.S. PATENT DOCUMENTS

| | | | | |
|---|---|---|---|---|
| 4,976,372 | A | | 12/1990 | Rogers, Jr. |
| 4,981,070 | A | * | 1/1991 | Larsen ..... 92/193 |
| 5,009,155 | A | | 4/1991 | Christianson |
| 5,366,642 | A | | 11/1994 | Platter et al. |
| 5,368,461 | A | | 11/1994 | Murphy |
| 5,419,693 | A | | 5/1995 | MacMillan |
| 5,423,666 | A | | 6/1995 | MacMillan |
| 5,497,812 | A | | 3/1996 | Orosco et al. |
| 5,534,145 | A | * | 7/1996 | Platter et al. ..... 210/90 |
| 5,535,926 | A | | 7/1996 | Blitz et al. |
| 5,622,729 | A | | 4/1997 | Mower |
| 5,711,462 | A | * | 1/1998 | Hard ..... 222/385 |
| 5,794,514 | A | * | 8/1998 | Pecorari ..... 92/71 |
| 5,814,351 | A | | 9/1998 | Mower |
| 5,878,925 | A | | 3/1999 | Denkins et al. |
| 5,882,691 | A | | 3/1999 | Conboy |
| 5,902,451 | A | | 5/1999 | O'Mara et al. |
| 5,924,598 | A | | 7/1999 | Bradshaw |
| 6,016,937 | A | | 1/2000 | Clay |
| 6,299,686 | B1 | | 10/2001 | Mills |
| 6,378,738 | B1 | | 4/2002 | Speaker et al. |
| 6,419,773 | B1 | | 7/2002 | Lauermann |
| 6,428,287 | B1 | | 8/2002 | Denkins et al. |
| 6,484,782 | B1 | | 11/2002 | Lewis et al. |
| 6,581,805 | B2 | | 6/2003 | Conboy et al. |
| 6,712,238 | B1 | | 3/2004 | Mills |
| 6,793,428 | B2 | | 9/2004 | Lithgow |
| 6,799,704 | B2 | | 10/2004 | Carleton |
| 6,820,648 | B2 | | 11/2004 | Castagnetta, Jr. |
| 6,874,557 | B2 | | 4/2005 | Jungklaus |
| 7,314,074 | B2 | | 1/2008 | Jungklaus |
| 7,318,716 | B2 | | 1/2008 | Castagnetta, Jr. |
| 7,624,782 | B2 | | 12/2009 | Jungklaus et al. |
| 7,721,377 | B2 | | 5/2010 | Jungklaus et al. |
| 7,798,194 | B2 | | 9/2010 | Jungklaus |
| 2004/0165932 | A1 | | 8/2004 | Grayden |
| 2005/0218157 | A1 | | 10/2005 | McMahon et al. |
| 2008/0128534 | A1 | | 6/2008 | McLeod |
| 2008/0292481 | A1 | | 11/2008 | Castagnetta, Jr. et al. |
| 2009/0083928 | A1 | | 4/2009 | Salvino |
| 2009/0094936 | A1 | | 4/2009 | Brown |
| 2009/0117284 | A1 | | 5/2009 | Watters |
| 2009/0129957 | A1 | | 5/2009 | Schlecht |
| 2009/0199971 | A1 | | 8/2009 | Ross |
| 2010/0014908 | A1 | | 1/2010 | Campbell et al. |
| 2010/0038513 | A1 | | 2/2010 | Hughes |
| 2010/0065719 | A1 | | 3/2010 | Szasz |
| 2010/0071852 | A1 | | 3/2010 | Jungklaus et al. |
| 2010/0196078 | A1 | | 8/2010 | Ovens |

OTHER PUBLICATIONS

Drywall Taping Tools, http://www.tapetech.com/Drywall-Taping-Tools-.aspx, 2 pages. Jul. 6, 2010.

* cited by examiner

DRYWALL MUD PUMP WITH IMPROVED CONNECTION BETWEEN THE PISTON AND THE ROD

FIELD OF THE INVENTION

This Invention relates to tools used to install and finish drywall in buildings and to hand pumps for pumping viscous fluids.

BACKGROUND OF THE INVENTION

Drywall, also known as gypsum board, wallboard, and plasterboard, is a building material used to finish the interior surfaces of walls and ceilings in houses and other buildings. Rigid sheets or panels of drywall are formed from gypsum plaster, the semi-hydrous form of calcium sulphate ($CaSO4.\frac{1}{2}\times H2O$), which is typically sandwiched between two layers of heavy paper or fiberglass mats. Drywall sheets are about ½ inch thick and are nailed or screwed in place to form the interior surfaces of the building, and provide fire resistance and sound deadening, among other benefits.

The joints between drywall sheets are typically filled and sealed with strips of paper or fiberglass mat and drywall joint compound, also called "joint compound", "drywall mud", or just "mud". Joint compound may be made, for example, of water, limestone, expanded perlite, ethylene-vinyl acetate polymer and attapulgite. Joint compound is applied as a viscous fluid that is thick enough to maintain its shape while it hardens. In addition to forming joints, drywall mud is used to cover nail or screw heads, form a smooth or flat surface, and provide a texture over the surface. Paint or wall paper is typically applied over the drywall and joint compound.

Workers often specialize in the installation of drywall, and in large projects different crews install the drywall panels (drywall hangers) from those who finish the joints and apply the joint compound (tapers or mudmen). Workers who specialize in drywall installation often use specialized tools to increase their productivity including flat boxes that are tools used to hold joint compound and apply it to drywall joints. Joint compound is often mixed (e.g., with water) or stored in buckets, and drywall mud pumps have been used to pump the mud from the buckets into flat boxes or other tools or containers.

U.S. patent application Ser. No. 11/292,238, publication 2007/0122301 (also by Werner Schlecht) describes a drywall mud pump. However, it was found that in operation pumping drywall joint compound that friction developed within the pump making it difficult to use. Thus, needs or potential for benefit exist for drywall mud pumps that have less internal friction. In addition, needs and potential for benefit exist for drywall mud pumps that are inexpensive to manufacture, reliable, easy to use, that have a long life, that are easy to service and clean, and that are simple in operation so that typical operators can effectively maintain them. Room for improvement exists over the prior art in these and other areas that may be apparent to a person of ordinary skill in the art having studied this document.

SUMMARY OF PARTICULAR EMBODIMENTS OF THE INVENTION

This invention provides, among other things, certain drywall mud (drywall joint compound) pumps with particular features or capabilities. Various embodiments provide, as objects or benefits, for example, that they have less internal friction than certain prior art pumps. In addition, particular embodiments provide, for instance, as objects or benefits, drywall mud pumps that are inexpensive to manufacture, reliable, easy to use, that have a long life, that are easy to service and clean, that are simple in operation, or a combination thereof. Other benefits of certain embodiments may be apparent to a person of ordinary skill in the art.

In specific embodiments, this invention provides certain drywall mud pumps that include a main cylinder and a rod having two ends, a first end and a second end. In many embodiments, when the drywall mud pump is assembled, the second end of the rod is located within the main cylinder, for example. Various embodiments also include a piston which, when the drywall mud pump is assembled, is also located within the main cylinder and is attached to the second end of the rod. In some embodiments, there is a connection structure between the piston and the second end of the rod, which is configured to allow the second end of the rod to move relative to the piston in a direction that is substantially perpendicular to the axis of the rod. A number of embodiments include a means for allowing the second end of the rod to move laterally relative to the piston within the main cylinder. Further, in some embodiments the piston specifically includes an elongated hole that receives the second end of the rod, and the elongated hole allows the second end of the rod to move laterally relative to the piston.

Various such embodiments further include a pump head, which may have an output aperture, and when the drywall mud pump is assembled, the pump head may be connected to the main cylinder and the rod may pass through the pump head. In some embodiments, the drywall mud pump further includes a handle and a linkage, and when the drywall mud pump is assembled, the handle may be pivotably connected to the first end of the rod, and the linkage may be pivotably connected to the pump head and pivotably connected to the handle, as examples. Moreover, some embodiments may include (e.g., in the pump head) a means for guiding the rod, a means for allowing the rod to pivot as the second end of the rod moves laterally relative to the piston, or both. Further, particular embodiments include a guide having a hole through which the rod slidably passes. Some embodiments include just one guide in the pump head, which may serve as both a guide and as a pivot point for the rod, and in some embodiments, the guide may be shortened to provide for pivoting.

In a number of embodiments, the piston includes an elastomeric piston cup having a first hole, which may be elongated, a top rigid support having a second elongated hole, a bottom rigid support having a third elongated hole, and a flapper having a fourth elongated hole. In some embodiments, when the drywall mud pump is assembled, the second end of the rod passes through each of the first, second, third, and fourth holes, for example. Further, certain embodiments include a means for preventing the piston from rotating about the rod. In some embodiments, as an example, the second end of the rod has a flattened portion, at least the second and third elongated holes are substantially the same size and have substantially the same shape, and, when the drywall mud pump is assembled, are held in a particular orientation by the flattened portion of the second end of the rod.

Even further, in some embodiments, when the drywall mud pump is assembled, the second end of the rod is attached to the piston with a nut (e.g., a lock nut), an elongated washer, or both. Moreover, in some embodiments, the piston cup, the top rigid support, and the bottom rigid support each have at least one passageway therethrough for passage of the drywall mud, and when the drywall mud pump is assembled, the flapper covers the (at least one) passageway substantially blocking passage of the drywall mud when the piston is moving in the main cylinder toward the pump head.

In various embodiments, the piston cup, the top rigid support, and the bottom rigid support each have multiple passageways therethrough for passage of the drywall mud, and the multiple passageways substantially surround the first, second, and third elongated holes. In addition, in some such embodiments, a plurality of the multiple passageways for passage of the drywall mud have at least one curved side and at least one straight side. Additionally, in particular embodiments wherein an elongated washer is provided, when the drywall mud pump is assembled, the washer substantially blocks the elongated hole in the piston to prevent drywall mud from passing through the elongated hole in the piston. In a number of such embodiments, the drywall mud pump may also include a means for controlling the rotational position of the washer.

Further, in some embodiments, the second end of the rod includes a first reduced diameter flattened section and a second reduced diameter flattened section. In some such embodiments, for example, the second reduced diameter flattened section has a smaller diameter, thickness between flats, or both, than the first reduced diameter flattened section. Further, in some embodiments, the second end of the rod also includes a threaded section. Further still, in some embodiments, when the drywall mud pump is assembled, the second end of the rod passes through each of the first, second, third, and fourth elongated holes such that the fourth elongated hole is located at the first reduced diameter flattened section, and the first, second and third elongated holes are located at the second reduced diameter flattened section. In addition, various other embodiments of the invention are also described herein.

Figures 1, 2:
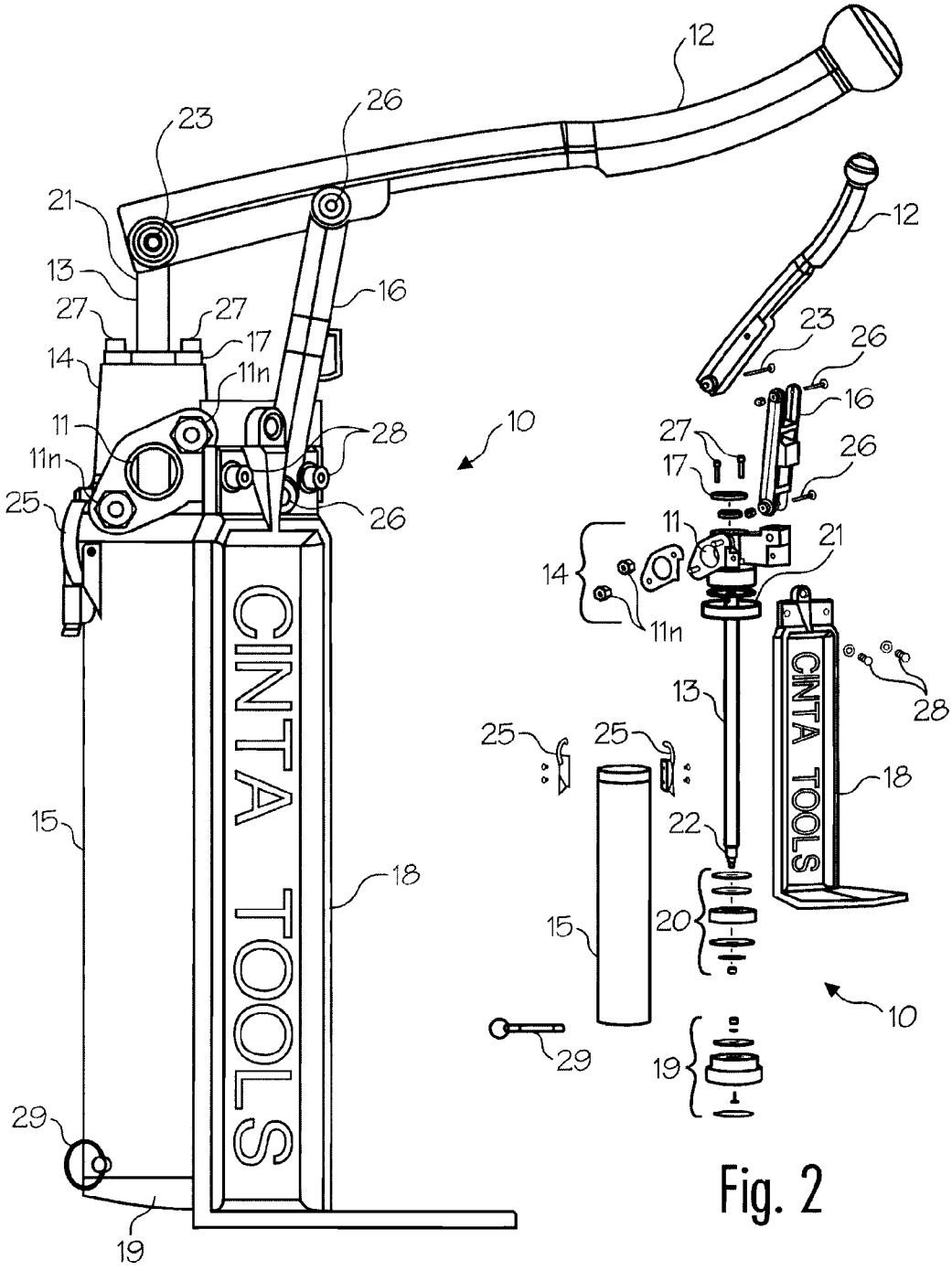
FIG. 1 is a side view of an example of an embodiment of a mud pump in accordance with the invention.
FIG. 2 is an isometric exploded view of the components of the mud pump shown in FIG. 1.

The drawings illustrate, among other things, a particular example of an embodiment of the invention, and various examples of characteristics thereof. Different embodiments of the invention include various combinations of elements shown in the drawings, described herein, known in the art, or a combination thereof.

DETAILED DESCRIPTION OF EXAMPLES OF EMBODIMENTS

FIG. 1 illustrates an example of an assembled drywall mud pump, pump 10. Parts and features that are visible from the outside in this view include output aperture 11 in pump head 14 where drywall mud emerges from pump 10 when handle 12 is moved, for example, by an operator of drywall mud pump 10. In some embodiments, a detachable high filler (not shown) may attach to aperture 11 (e.g., with the nuts 11*n* shown) and may extend the location where the mud emerges to a higher elevation to enhance ergonomics. FIG. 2 is an exploded view of the same embodiment of drywall mud pump 10 shown in FIG. 1.

In the embodiment illustrated, rod 13 passes through pump head 14 (visible in FIG. 1 through aperture 11) into main cylinder 15. Pump head 14 is mounted on or connected to main cylinder 15, in this embodiment, with clips 25. Also in this embodiment, handle 12 is pivotably connected to the top or first end 21 of rod 13 with pin 23, and linkage 16 is pivotably connected at the top (of linkage 16) to handle 12 and at the bottom (of handle 16) to pump head 14 with bolts 26.

Other visible parts of pump 10 include foot plate 18, which is connected to pump head 14 with bolts 28, in this embodiment, and foot valve 19, which is connected to the bottom end of cylinder 15 with pin 29. When in use, main cylinder 15 may extend into a bucket of drywall joint compound or mud while foot plate 18 may extend outside of the bucket to the floor. The operator may place his foot on foot plate 18 to steady pump 10 while moving handle 12. Foot valve 19, in the bottom of the bucket, may form or include a check valve that may allow mud to flow upward into cylinder 15, but may substantially prevent mud from flowing downward out of cylinder 15 through foot valve 19. Rod 13 also passes through shortened guide 17, in this embodiment, and guide 17 is attached to pump head 14 with bolts 27. Thus, guide 17 is easily removable and replaceable.

FIG. 2 also introduces piston 20, which, in this embodiment, includes several different components that will be discussed in more detail with reference to other figures. In this embodiment, when drywall mud pump 10 is assembled, piston 20 is located within main cylinder 15 and is attached to the bottom or second end 22 of rod 13. In addition, when drywall mud pump 10 is assembled, second end 22 of rod 13 is also located within main cylinder 15. When an operator pushes handle 12 down, piston 20 goes up toward pump head 14, pushing drywall mud that is in cylinder 15 out through aperture 11. During this process, a vacuum is created below piston 20, which draws more drywall mud into cylinder 15 through foot valve 19. When the operator pulls handle 12 up, piston 20 goes down, away from pump head 14, foot valve 19 prevents the drywall mud below piston 20 from exiting cylinder 15 through the bottom, and drywall mud flows through piston 20, as will be described in more detail below.

During the operation of mud pump 10, horizontal or lateral forces are exerted on rod 13. Even if the operator only exerts vertical forces on handle 12, since linkage 16 is not vertical during most of the stroke of piston 20, linkage 16 exerts lateral forces on handle 12, which are carried by handle 12 to rod 13. These horizontal or lateral forces on rod 13 are believed to cause increased friction or binding within prior art drywall mud pumps. In a number of embodiments, drywall mud pump 10, and various other drywall mud pumps in accordance with this invention, allow rod 13 to move laterally without binding (or with reduced binding) and in a manner that reduces friction (e.g., within mud pump 10). In different embodiments, such a reduction in friction makes the drywall mud pump (e.g., 10) easier to use. In addition, in many embodiments, reduced friction reduces wear, thus increasing pump life, maintaining a level of pump performance for a longer time, reducing the need for replacement of parts, reducing the need for servicing of the pump, or the like.

Figure 3:
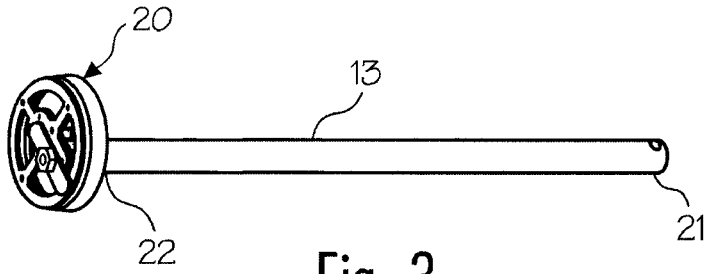
FIG. 3 is an isometric view of the assembled piston and rod of the mud pump of FIGS. 1 and 2.
Figure 4:
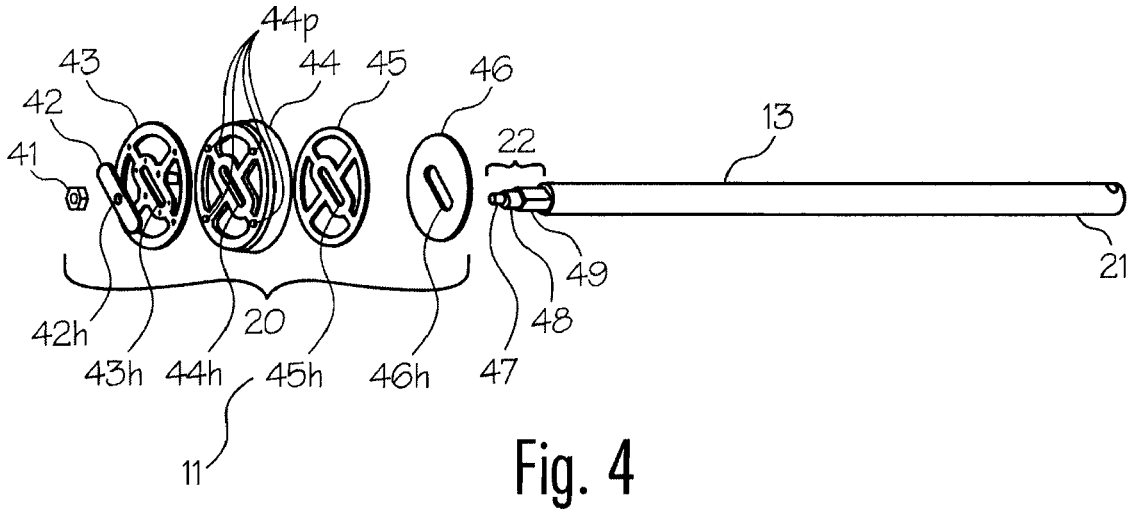
FIG. 4 is an isometric exploded view of the components of the piston and the rod of the mud pump of FIGS. 1-3.

FIG. 3 is a closer view of assembled piston 20 attached to second end 22 of rod 13. FIG. 4 is an exploded view of piston 20 and rod 13, and shows the components of piston 20 and details of second end 22 of rod 13, in the embodiment illustrated. In this embodiment, piston 20 includes nut 41, elongated washer 42, bottom wiper support 43, piston seal, wiper, or cup 44, top wiper support 45, and flapper 46. In some embodiments, a means may be provided for preventing nut 41 from turning or loosening once nut 41 is installed. In many embodiments, for example, nut 41 is a lock nut (e.g., having a nylon insert), but in other embodiments, nut 41 may be a regular (hexagonal) machine nut. In some embodiments, nut 41, piston 20, or rod 13 may include a cotter key, set screw, jam nut, lock washer, or the like, to prevent nut 41 from turning once installed. Further, in other embodiments, a bolt, machine screw, snap ring, other fastener, or the like, may be provided instead of nut 41.

In a number of embodiments, piston cup 44 may be an elastomeric material such as rubber or a synthetic equivalent thereof. Other components shown in FIGS. 3 and 4 may be metal, such as steel, stainless steel, brass, bronze, aluminum, or the like, or may be made of a plastic, a polymer, or nylon, for example. In the embodiment illustrated, piston cup 44 has an outside diameter that is slightly larger than the inside diameter of main cylinder 15. Thus, an interference fit may exist between piston cup 44 and main cylinder 15, and when piston 20 is inside main cylinder 15 (e.g., when drywall mud pump 10 is assembled), the outside diameter of piston cup 44 may contact the inside surface of main cylinder 15.

Bottom wiper support 43, in this embodiment, has an outside diameter that is less than the outside diameter of piston cup 44, and slightly less than the inside diameter of main cylinder 15. Bottom wiper support 43 may be rigid, may provide support to piston cup 44, and may have a clearance fit with main cylinder 15. Top wiper support 45, in this embodiment, has an outside diameter that is less than the outside diameter of piston cup 44, less than the inside diameter of main cylinder 15, and may have an outside diameter that is less than (or equal to) the outside diameter of bottom wiper support 43. Top wiper support 45 may also be rigid, and may also provide support to piston cup 44. As used herein, components of piston 20 are said to be rigid if the material that the components are made of has a stiffness (i.e., modulus of elasticity) that is at least twice that of the material that piston cup 44 is made of.

Flapper 46, in this embodiment, has an outside diameter that is less than the outside diameter of piston cup 44, less than the inside diameter of main cylinder 15, and may be less than the outside diameter of bottom wiper support 43, top wiper support 45, or both. In this embodiment, Flapper 46 has a diameter that is sufficiently small to allow drywall mud to flow between flapper 46 and the inside surface of main cylinder 15, for example, when piston 20 is traveling downward (e.g., away from pump head 14). In the embodiment illustrated, flapper 46 is rigid. In other embodiments, flapper 46 may be flexible. In some embodiments, flapper 46 (or an alternative flapper) may bend or pivot out of the way of the flow of drywall mud when piston 20 is traveling downward, for example. In some embodiments, a flapper or component analogous to flapper 46 may be made of two or more pieces, which may be different materials and may have different stiffnesses.

In a number of embodiments, piston 20 includes an (e.g., at least one) elongated hole that receives second end 22 of rod 13. Such an elongated hole may allow second end 22 of rod 13 to move laterally relative to piston 20, for example. As used herein, "laterally" means in a direction that is substantially perpendicular to the longitudinal axis of rod 13. As used herein, "substantially perpendicular", unless stated otherwise, means 90 degrees, plus or minus 30 degrees, and "perpendicular" (without being preceded by "substantially"), unless stated otherwise, means 90 degrees, plus or minus 5 degrees.

In the embodiment illustrated, piston cup 44 of piston 20 has a first elongated hole **44*h*, top support 45 has a second elongated hole 45*h*, bottom support 43 has a third elongated hole 43*h*, and flapper 46 has a fourth elongated hole 46*h*. In the embodiment shown, when drywall mud pump 10 is assembled, second end 22 of rod 13 passes through each of the first, second, third, and fourth elongated holes (i.e., 43*h*, 44*h*, 45*h*, and 46*h*). Further, the embodiment illustrated includes a means for preventing piston 20 from rotating about rod 13. Specifically, in the embodiment illustrated, second end 22 of rod 13 has first and second flattened portions 49 and 48, which, in this embodiment, each have a reduced diameter from the remainder of rod 13. In this embodiment, the second and third elongated holes (i.e., holes 45*h* and 43*h* in top and bottom supports 45 and 43) are substantially the same size and have substantially same shape, and, when drywall mud pump 10 is assembled, are held in a particular orientation by second flattened portion 48 of second end 22 of rod 13**.

As used herein, "substantially the same", when referring to a dimension, unless stated otherwise, means the same to within 10 percent. In addition, as used herein "held in a particular orientation" when referring to a piston or part of a piston, means that the piston or part is prevented from rotating about the longitudinal axis of the rod by more than 45 degrees. In some embodiments, first hole **44*h* may also have substantially the same size and shape as holes 43*h* and 45*h*. In other embodiments, first hole 44*h* may have a different shape. In certain embodiments, for example, first hole 44*h*, or a corresponding hole in the piston cup, may be round, may be larger than third hole 43*h* or second hole 45*h*, or both. Further, in a number of embodiments, different components of the piston (e.g., components 43-46 of piston 20) may have elongated holes, while in other embodiments, an elongated hole may appear only in one component of the piston, or in one of the top and bottom supports, for example, to hold the piston in a particular orientation with a flattened portion of the second end of the rod. In some embodiments, for example, the third hole 43*h* in bottom support 43 may be round, may be larger than the second hole 45*h* in top support 45, or both, and in other embodiments, second hole 45*h* may be round, may be larger than third hole 43*h***, or both.

In the embodiment illustrated, second reduced diameter flattened section 48 has a smaller diameter and thickness between flats than first reduced diameter flattened section 49. Other embodiments may have different sections that just have different diameters or different thicknesses between flats. Further, in the embodiment shown, second end 22 of rod 13 also includes threaded section 47, which in this embodiment, receives nut 41. Further still, when drywall mud pump 10 is assembled, second end 22 of rod 13 passes through each of first, second, third, and fourth elongated holes **43*h*-46*h* such that fourth elongated hole 46*h* is located at first reduced diameter flattened section 49, and first, second and third elongated holes 43*h*-45*h* are located at second reduced diameter flattened section 48**.

In the embodiment illustrated, second end 22 of rod 13 has two reduced diameter flattened portions 48 and 49. In other embodiments, just one flattened portion may be provided, or 3 or more distinct flattened portions may be provided, as examples. Also, in the embodiment illustrated, the flattened portions (e.g., 48 and 49) and the elongated holes **43*h*, 44*h***,

45*h*, and 46*h* have round or rounded ends. Other embodiments may have square ends (e.g., a rectangular cross section) or another shape.

In the embodiment shown, flattened portion 49 has a sufficient dimension in the axial direction (i.e., of the longitudinal axis of rod 13) to allow flapper 46 to move away from top support 45 when piston 20 is traveling downward away from pump head 14. This allows room for the drywall mud to flow outward between flapper 46 and top support 45 before flowing around the outside of flapper 46. When piston 20 travels in upward, toward pump head 14, flapper 46 moves in the axial direction to the other end of flattened portion 49 until flapper 46 makes contact with top support 45.

In some embodiments, there is a connection structure between the piston (e.g., 20) and second end (e.g., 22) of the rod (e.g., 13) that is configured to allow the second end (e.g., 22) of the rod (e.g., 13) to move relative to the piston (e.g., 20) in a direction that is substantially perpendicular to the axis of the rod (e.g., rod 13). The elongated hole or holes (e.g., 43*h*, 44*h*, 45*h*, 46*h*, or a combination thereof) through which second end 22 of rod 13 passes, is an example of such a connection structure. Further, a number of embodiments, including the embodiment illustrated, include a means for allowing the second end (e.g., 22) of the rod (e.g., 13) to move laterally relative to the piston (e.g., 20) within the main cylinder (e.g., 15). Other embodiments, besides what is shown in the drawings, may differ in geometry. For example, some embodiments may use a slot or hole in the rod, a pin, a track, a linkage, or the like.

As used herein, a means for allowing an end of a rod to move laterally relative to a piston does not include motion resulting from prior art magnitude clearance between the rod and the piston in a drywall mud pump, movement resulting from deformation of an elastomeric piston cup, or deformation of the rod or other components resulting from stress imposed thereon. Rather, a means for allowing an end of a rod to move laterally relative to a piston requires a structure that provides for substantially more lateral movement of the rod under substantially less force than prior art mud pump technology provided. In this context, as used herein, "substantially" means by a factor of at least two.

In different embodiments, the second end 22 of rod 13 may be able to move laterally relative to piston 20 by at least or about 1/16, 1/8, 3/16, 1/4, 5/16, 3/8, 7/16, 1/2, 9/16, 5/8, 1/4, 7/8, 1, 1 1/8, 1 1/4, or 1 1/2, inch, or 2 inches, for example, under lateral forces normally present within such a drywall mud pump. In the embodiment illustrated, the elongated hole (e.g., 43*h*) in piston 20 is centered within piston 20. But in other embodiments, the elongated hole may extend from the center of piston 20 in one direction, or may extend farther on one side of center than the other, as examples.

In the embodiment illustrated, nut 41 does not clamp down on bottom support 43, piston cup 44, and top support 45. Rather, sufficient clearance is left between nut 41 and support 43, piston cup 44, and top support 45 to allow them to move freely in the lateral direction across elongated holes 43*h*-45*h*. The axial dimension of flattened portion 48 may be sized accordingly. In some embodiments, where nut 41 is a lock nut, for example, nut 41 may be turned until the correct amount of clearance is obtained. In other embodiments, nut 41 may be tightened against the end of threaded portion 47, as another example.

Figure 5:
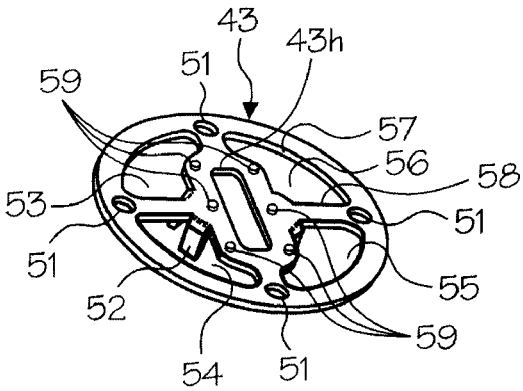
FIG. 5 is a detailed isometric view illustrating an example of the bottom rigid support of the mud pump of FIGS. 1-4.

FIG. 5 is a detailed view of the same embodiment of bottom support 43. Bottom support 43 includes elongated hole 43*h* which has round ends (i.e., part of a circle). Bottom support 43 includes round holes 51 which receive projections 44*p* (shown in FIG. 4) of piston cup 44. Projections 44*p* may have an interference fit with holes 51, in this embodiment, and may help to hold piston cup 44 in place (e.g., held in the appropriate particular orientation) relative to bottom support 43. In the embodiment shown, bottom support 43 also includes tabs 52 which also help to hold piston cup 44, top support 45, or both in place (e.g., held in the appropriate particular orientation) relative to bottom support 43. The embodiment illustrated includes four tabs 52, although only one of tabs 52 is labeled with a reference number, the one that is the most visible from the perspective of FIG. 5.

Bottom support 43 also includes multiple passageways 53, 54, 55, and 56 therethrough for passage of drywall mud. These passageways 53, 54, 55, and 56 substantially surround (third) elongated hole 43*h*. As shown in FIG. 4, in the embodiment illustrated, corresponding passageways having substantially the same shape extend through piston cup 44 and top support 45 and substantially surround (first and second) holes 44*h* and 45*h*, as well. Drywall mud flows through these passageways (e.g., 53-56), between top support 45 and flapper 46, and around the outside of flapper 46 (i.e., between flapper 46 and the inside of main cylinder 15) when piston 20 is moving downward (i.e., away from pump head 14).

Still referring to FIG. 5, in the embodiment illustrated, all four of the multiple passageways 53, 54, 55, and 56 for passage of drywall mud have at least one curved side 57 and at least one straight side 58, as labeled, for example, for passageway 56. In the embodiment illustrated, the shape of passageways 53, 54, 55, and 56 provides for essentially as much area for the flow of drywall mud therethrough as possible, while maintaining adequate structural strength of the components (e.g., bottom support 43, piston cup 44, etc.).

As mentioned, when piston 20 is traveling upward (i.e., toward pump head 14) in cylinder 15, flapper 46 makes contact with top support 45, blocking or substantially blocking passageways 53, 54, 55, and 56, thus preventing significant quantities of the drywall mud from flowing back through passageways 53, 54, 55, and 56. As used herein, in the context of blocking the flow of drywall mud, "substantially blocking" means blocking more than 90 percent of the cross sectional area (e.g., of passageways 53, 54, 55, and 56), and "blocking" (i.e., without being preceded by "substantially") means blocking more than 99 percent of the cross sectional area (e.g., of passageways 53, 54, 55, and 56). Blocking or substantially blocking of passageways 53, 54, 55, and 56, in the embodiment illustrated, causes the drywall mud within cylinder 15 to exit through pump head 14 and orifice 11 when piston 20 travels upward (i.e., toward pump head 14).

Further, as shown for example in FIG. 3, in the embodiment illustrated, when drywall mud pump 10 is assembled, washer 42 blocks or substantially blocks the elongated hole (e.g., 43*h*, 44*h*, 45*h*, and 46*h*) in piston 20 to prevent drywall mud from passing through the elongated hole in piston 20 (e.g., when piston 20 is moving upward toward pump head 14). In a number of such embodiments, the drywall mud pump (e.g., 10), piston (e.g., 20), or rod (e.g., 13) may also include a means for controlling the orientation or rotational position (i.e., about the longitudinal axis of rod 13) of the washer (e.g., 42). This may facilitate washer 42 blocking or substantially blocking the elongated hole (e.g., 43*h*).

In the embodiment illustrated, projections 59 of bottom support 43 control the rotational position of washer 42, and align washer 42 with elongated hole 43*h* to block or substantially block hole 43*h*. Elongated holes 44*h*, 45*h*, and 46*h*, in this embodiment, line up with hole 43*h*, and are also blocked by washer 42. In other embodiments, elongated washer 42 may be attached to or integral with nut 41 (e.g., a lock nut or with another means to prevent nut 41 from rotating on its own accord) or may have a tab that bends against a flat of nut 41, as examples. In other embodiments, washer 42 may be guided by a track, grove, projection, indentation, spline(s), or the like on bottom support 43, nut 41, or portions 47 or 48 of end 22 of rod 13, as examples. Further, in the embodiment illustrated, hole 42*h* in elongated washer 42 is round, but in other embodiments, hole 42*h* may be elongated and may fit over a flattened section (e.g., section 48 of rod 13), or washer 42 may have a tab or projection that may fit into a slot in second end 22 of rod 13 to limit or prevent rotation of washer 42, as other examples. In other embodiments, hole 42*h* may be square, splined, hexagonal, octagonal, star shaped, or the like, and second end 22 of rod 13 may have a corresponding or mating shape. In another embodiment, hole 42*h* of washer 42 is threaded and nut 41 locks against washer 42 to prevent washer 42 from rotating relative to rod 13, as another example.

Figure 6:
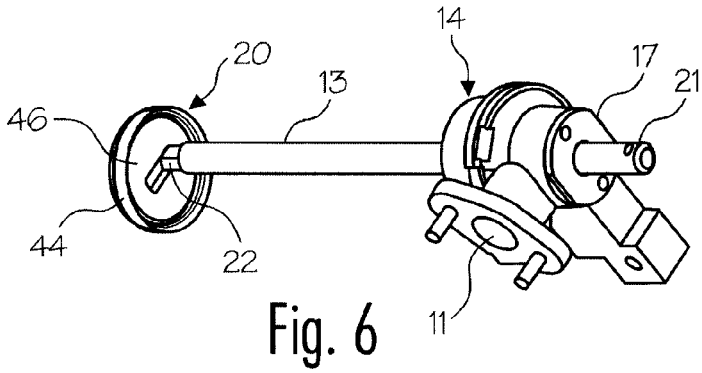
FIG. 6 is an isometric view of the assembled piston, rod, and pump head of the example of a mud pump of the previous figures.
Figure 7:
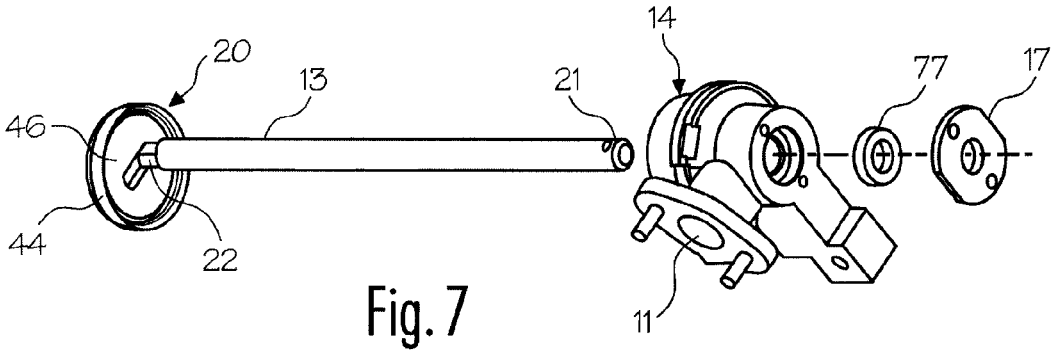
FIG. 7 is an isometric exploded view of the piston, rod, and pump head of the example of a mud pump of the previous figures, except that the piston in FIG. 7 is not shown exploded.

FIG. 6 illustrates piston 20, rod 13, pump head 14, and shortened guide 17, all assembled. In this view, flapper 46 is shown against upper guide 45 (not visible) blocking or substantially blocking passageways 53, 54, 55, and 56, as would be the case when piston 20 is moving toward pump head 14. FIG. 7 shows these same components of drywall mud pump 10 in an exploded view, except that piston 20 is not separated into components or separated from rod 13. FIG. 7 shows, among other things, that below guide 17 is a wiper or rod seal 77, which may be made of an elastomeric material or synthetic rubber, for example, and may serve to prevent or substantially prevent drywall mud from within main cylinder or pump head 14 from traveling up along rod 13 through guide 17. Rod seal 77 may have a U-shaped cross section, for example, with the opening of the U pointed downward (i.e., toward piston 20). In other embodiments, rod seal 77 may have a cross section that is square, rectangular, triangular, trapezoidal, a parallelogram, or round, as examples, and may be solid or hollow.

Figure 8:
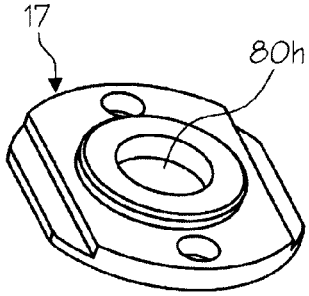
FIG. 8 is a detailed isometric view of an example of a guide for the mud pump of the previous figures.
Figure 9:
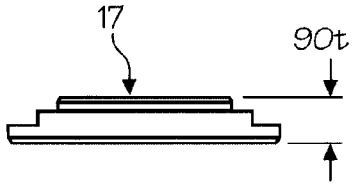
FIG. 9 is a detailed side view of the guide of FIG. 8.

FIGS. 8 and 9 illustrate more detail of the example of guide 17 of the embodiment illustrated. Guide 17, in this embodiment, includes hole 80*h* through which rod 13 passes when drywall mud pump 10 is assembled. Some embodiments may include (e.g., in pump head 14) a means for guiding rod 13, a means for allowing rod 13 to pivot (e.g., without binding) as second end 22 of rod 13 moves laterally relative to piston 20, or both. In the embodiment illustrated, guide 17 is a shortened guide, and rod 13 slidably passes through hole 80*h* when pump 10 is assembled. Prior art guides for drywall mud pumps typically have a gland nut with a dimension 90*t* (shown in FIG. 9) in the direction of the longitudinal axis of rod 13 that is ¾ inch or more. In the embodiment illustrated, guide 17 has a dimension 90*t* of 0.300 inches. Other embodiments may have a dimension 90*t* that is more than ⅛, 3/16, or ¼ inch, and less than ½, ⅜ or 5/16 inch, or the like, as examples. As used herein, a "shortened guide" has a dimension 90*t* that is less than ½ inch.

Prior art gland nuts, which served as guides, typically included a recess within the gland nut for a bushing or liner that provided a sliding surface for the rod. This liner often consisted of a non-metal, such as nylon. Shortened guide 17, in the embodiment illustrated, however, does not include a recess for a bushing or liner, and in fact, no such liner is used in the embodiment shown. Rather, rod 13 slides directly on guide 17. Other embodiments may include a bushing or liner within a guide or gland nut, but may provide another means for allowing the rod to pivot (e.g., without binding) as the (second) end of the rod moves laterally relative to the piston. In some embodiments, for example, a bushing or liner may be provided that is made of or includes nylon, PTFE, or the like. In some embodiments in which the gland nut or guide is not shortened, for example, the guide may have a larger diameter or an elongated hole (e.g., 80*h*) therethrough. In other embodiments, a structure may be provided to allow the guide to pivot, as another example.

In some embodiments, guide 17 serves both as a guide and as a pivot point for rod 13. In some such embodiments, the outside diameter of rod 13 and the inside diameter of hole 80*h* are selected to provide sufficient clearance between rod 13 and hole 80*h* to allow second end 22 of rod 13 to move laterally over, for instance, the full range of the elongated hole (e.g., 43*h*, 44*h*, 45*h*, 46*h*, or a combination thereof) in piston 20 without causing binding between rod 13 and hole 80*h*, for example, within guide 17. Further, in the prior art, upper and lower guides were used at the top and bottom of the pump head (e.g., otherwise similar to pump head 14). This provided little opportunity for the rod (e.g., similar to rod 13) to pivot in the pump head, and (as used herein) no means for allowing the rod to pivot as the second end of the rod moves laterally relative to the piston. In the embodiment shown, only one (i.e., a single) guide (17) is provided, and guide 17 is shortened, which (as used herein), if sized or shaped in certain ways, may provide a means for allowing rod 13 to pivot without binding as second end 22 of rod 13 moves laterally relative to piston 20.

In some embodiments, hole 80*h* may be round or a circular cylinder (e.g., a right circular cylinder), such as a drilled hole. In other embodiments, hole 80*h* may be elongated to allow rod 13 to pivot. In some embodiments, in particular, hole 80*h* may be round at one location (e.g., at the top or bottom surface of guide 17, or at a location therebetween) and elongated elsewhere, or may be elongated throughout, but the amount of elongation may vary. For example, in a number of embodiments, the elongation may become more pronounced further from the location where hole 80*h* is round, or further from a location where the elongation is a minimum. In some embodiments, for example, hole 80*h* is round or only slightly elongated at the bottom of guide 17, adjacent to seal 77, and maximum elongation occurs at the top of guide 17.

In some embodiments, hole 80*h* is manufactured as a right circular cylinder (e.g., a drilled hole), but quickly "wears in" when in use, to a shape that is elongated, for instance, with the most pronounced elongation at the top or bottom surface (or both) of guide 17. In some such embodiments, guide 17 is made of a relatively soft material, such as brass, and rod 13 is made of a harder material, such as stainless steel, which may be grade 420 stainless steel, and may be hardened to 35 Rockwell C (HRC), for example. In particular embodiments, rod 13 has an outside diameter of 0.626±0.005 inches, and hole 80*h* in guide 17 has an inside diameter of 0.640±0.003 inches, for instance. In various such embodiments, friction in the operation of pump 10 may be greater when pump 10 is new, but may decrease once guide 17 wears in and binding between guide 17 and rod 13 declines or ceases. Such a shortened guide 17 that is configured to "wear in" to a shape that does not bind against rod 13, as used herein, is another example of a means for allowing rod 13 to pivot as second end 22 of rod 13 moves laterally relative to piston 20.

In the embodiment illustrated, once guide 17 wears in, and binding between guide 17 and rod 13 declines or ceases, the rate at which guide 17 wears may decrease substantially. However, in cases of frequent use of pump 10, guide 17 may continue to wear over time with continued use. At some point, guide 17 may be replaced. In the embodiment shown, guide 17 and seal 77 are easily replaceable by removing pin 23 and bolts 27.

In the embodiment illustrated, rod 13 has a round cross section, but in other embodiments, a corresponding rod may have a square, rectangular, hexagonal, octagonal, or other cross section. The round cross section illustrated may facilitate seal 77 shown in FIG. 7, although other cross section rods can be sealed adequately. In different embodiments, such a rod (e.g., 13) may be solid or hollow.

What is claimed is:

1. An assemblable drywall mud pump, wherein, when the drywall mud pump is assembled, the drywall mud pump comprises:

a main cylinder;

a rod having a first end and a second end, wherein the second end is located within the main cylinder; and a piston located within the main cylinder and attached to the rod, wherein the piston comprises an elongated hole that receives the second end of the rod, wherein the elongated hole allows the second end of the rod to move laterally relative to the piston, and wherein the piston comprises an elastomeric piston cup having a first elongated hole, a top rigid support having a second elongated hole, a bottom rigid support having a third elongated hole, and a flapper valve having a fourth elongated hole.

2. The assemblable drywall mud pump of claim 1, wherein the second end of the rod passes through each of the first, second, third, and fourth elongated holes.

3. The assemblable drywall mud pump of claim 1, wherein the second end of the rod has a flattened portion, and wherein at least the second and third elongated holes are substantially the same size, have substantially the same shape, and are held in a particular orientation by the flattened portion of the second end of the rod.

4. The assemblable drywall mud pump of claim 1, further comprising a pump head, wherein the piston cup, the top rigid support, and the bottom rigid support each have at least one passageway therethrough for passage of the drywall mud, wherein the flapper valve covers the at least one passageway, substantially blocking passage of the drywall mud when the piston is moving in the main cylinder toward the pump head.

5. The assemblable drywall mud pump of claim 1, wherein the piston cup, the top rigid support, and the bottom rigid support each have multiple passageways therethrough for passage of drywall mud, wherein the multiple passageways substantially surround the first, second, and third elongated holes, and wherein a plurality of the multiple passageways for passage of drywall mud have at least one curved side and at least one straight side.

6. The assemblable drywall mud pump of claim 1, further comprising:

a pump head having an output aperture, wherein the pump head is connected to the main cylinder and the rod passes through the pump head; and a handle and a linkage, wherein the handle is pivotably connected to the first end of the rod, and the linkage is pivotably connected to the pump head and pivotably connected to the handle.

7. The assemblable drywall mud pump of claim 1, further comprising a pump head, wherein the pump head is connected to the main cylinder, and wherein the rod passes through the pump head.

8. The assemblable drywall mud pump of claim 7, wherein the pump head allows the rod to pivot as the second end of the rod moves laterally relative to the piston.

9. The assemblable drywall mud pump of claim 1, further comprising a pump head, wherein the pump head is connected to the main cylinder, wherein the rod passes through the pump head, wherein the pump head comprises a single shortened guide having a hole through which the rod slidably passes, and wherein the guide serves as a pivot point for the rod.

10. An assemblable drywall mud pump, wherein, when the drywall mud pump is assembled, the drywall mud pump comprises:

a main cylinder;

a rod having a first end and a second end, wherein the second end is located within the main cylinder; and a piston located within the main cylinder and attached to the rod, wherein the piston comprises an elongated hole that receives the second end of the rod, wherein the elongated hole allows the second end of the rod to move laterally relative to the piston, and wherein the second end of the rod is attached to the piston with a lock nut and an elongated washer.

11. An assemblable drywall mud pump, wherein, when the drywall mud pump is assembled, the drywall mud pump comprises:

a main cylinder;

a rod having a first end and a second end, wherein the second end is located within the main cylinder;

a piston located within the main cylinder and attached to the rod, wherein the piston comprises an elongated hole that receives the second end of the rod, and wherein the elongated hole allows the second end of the rod to move laterally relative to the piston; and an elongated washer, wherein the washer substantially blocks the elongated hole in the piston to prevent drywall mud from passing through the elongated hole in the piston, and wherein the drywall mud pump comprises a means for controlling the rotational position of the washer.

12. An assemblable drywall mud pump, wherein, when the drywall mud pump is assembled, the drywall mud pump comprises:

a main cylinder;

a rod having a first end and a second end, wherein the second end is located within the main cylinder; and a piston located within the main cylinder and attached to the rod, wherein the piston comprises an elongated hole that receives the second end of the rod, wherein the elongated hole allows the second end of the rod to move laterally relative to the piston, and wherein the second end of the rod includes a first reduced diameter flattened section and a second reduced diameter flattened section, wherein the second reduced diameter flattened section has a smaller diameter and thickness between flats than the first reduced diameter flattened section, and wherein the second end of the rod also includes a threaded section.

13. The assemblable drywall mud pump of claim 12, wherein the piston comprises a flexible piston cup having a first elongated hole, a top rigid support having a second elongated hole, a bottom rigid support having a third elongated hole, and a flapper valve having a fourth elongated hole, wherein the second end of the rod passes through each of the first, second, third, and fourth elongated holes such that the fourth elongated hole is located at the first reduced diameter flattened section, and the first, second and third elongated holes are located at the second reduced diameter flattened section, and wherein the second end of the rod is attached to the piston with a nut located on the threaded section of the rod.

* * * * *